US007789732B2

(12) United States Patent
Grady et al.

(10) Patent No.: US 7,789,732 B2
(45) Date of Patent: Sep. 7, 2010

(54) SUPERABRASIVE TOOL

(75) Inventors: Daniel F. Grady, Athens (GR); Jon C. Hammett, Windham, CT (US); Stephen G. Roseberry, Meriden, CT (US); Brian J. Schwartz, West Hartford, CT (US)

(73) Assignee: United Technologies Corporation, Hartford, CT (US)

( * ) Notice: Subject to any disclaimer, the term of this patent is extended or adjusted under 35 U.S.C. 154(b) by 686 days.

(21) Appl. No.: 11/473,866

(22) Filed: Jun. 22, 2006

(65) Prior Publication Data

US 2006/0246824 A1 Nov. 2, 2006

Related U.S. Application Data

(62) Division of application No. 10/918,937, filed on Aug. 16, 2004.

(51) Int. Cl.
*B24B 1/00* (2006.01)

(52) U.S. Cl. ..... 451/28; 451/178

(58) Field of Classification Search ..... 451/28, 451/51, 58, 177, 179, 540, 547, 57
See application file for complete search history.

(56) References Cited

U.S. PATENT DOCUMENTS

| | | | | |
|---|---|---|---|---|
| 3,709,308 | A * | 1/1973 | Rowley et al. | 175/434 |
| 3,774,349 | A * | 11/1973 | Uhtenwoldt et al. | 451/25 |
| 5,803,680 | A * | 9/1998 | Diener | 409/130 |
| 6,543,991 | B2 * | 4/2003 | Sathianathan et al. | 415/9 |
| 6,851,418 | B2 * | 2/2005 | Takemura et al. | 125/36 |

FOREIGN PATENT DOCUMENTS

JP 2-35676 U 3/1990

* cited by examiner

*Primary Examiner*—Joseph J Hail, III
(74) *Attorney, Agent, or Firm*—Bachman & LaPointe, P.C.

(57) ABSTRACT

A tool for use in an abrasive machining process has a body extending along a central longitudinal axis from a first end to a tip end. An abrasive material is located on the tip end. A central recess is formed in the tip end.

20 Claims, 3 Drawing Sheets

SUPERABRASIVE TOOL

CROSS-REFERENCE TO RELATED APPLICATION

This is a divisional application of Ser. No. 10/918,937, filed Aug. 16, 2004, and entitled SUPER-ABRASIVE TOOL, the disclosure of which is incorporated by reference herein as if set forth at length.

BACKGROUND OF THE INVENTION

The invention relates to machining. More particularly, the invention relates to superabrasive machining of metal alloy articles Apparatus for point and flank superabrasive machining (SAM) of turbomachine components are respectively shown in commonly-owned U.S. patent application Ser. Nos. 10/289,493 and 10/400,937, respectively filed Nov. 6, 2002 and Mar. 27, 2003. Commonly-owned U.S. patent application Ser. No. 10/627,153, filed Jul. 24, 2003, discloses methods and apparatus for machining blade retention slots. The '153 application discusses orienting the axis of quill rotation off-normal to a traversal direction so as to address a lack of grinding action at the center of the quill tip.

SUMMARY OF THE INVENTION

One aspect of the invention involves a tool for use in an abrasive machining process. A body extends along a central longitudinal axis from a first end to a tip end. An abrasive material is located on the tip end. A central recess is formed in the tip end.

In various implementations, the tool may have a number of additional recesses extending from the central recess. The additional recesses may be elongate recesses extending generally toward the first end. The elongate recesses may each have a recess length and may be partially circumferentially oriented and partially longitudinally oriented along a major portion of such recess length. There may be 2-4 such recesses. The body may include a tip end protuberance. The body may include a threaded portion for engaging a machine, a flange having a pair of flats for receiving a wrench, and a shaft extending tipward from the flange. The abrasive may comprise a coating. The abrasive may be selected from the group consisting of plated cubic boron nitride, vitrified cubic boron nitride, diamond, silicon carbide, and aluminum oxide. The tool may be combined with a machine rotating the tool about the longitudinal axis at a speed in excess of 10,000 revolutions per minute.

Another aspect of the invention involves a method for manufacturing such a tool. A pilot hole is drilled in the tip end. The pilot hole is counterbored. The abrasive is applied as a coating. The coating may be adjacent the recesses and may be along the recesses. A number of additional recesses may be machined extending from the central recess. The additional recesses may be elongate and extend generally toward the first end.

Another aspect of the invention involves a process for point abrasive machining of a workpiece. A tool is provided having a tip grinding surface coated with an abrasive and having a central tip recess. The tool is oriented relative to a surface of the workpiece so that there is contact between the surface and the grinding surface. A part is formed by removing material at the contact by rotating the tool about the central longitudinal axis.

In various implementations, the tool may be rotated at a speed in the range of 40,000 to 120,000 revolutions per minute. The longitudinal axis may be reoriented relative to the workpiece while machining the workpiece. The workpiece may comprise a component selected from the group consisting of integrally bladed disks and turbine engine case components. The machining may form an interblade floor of the disk or an exterior pocket of the component. The workpiece may comprise or may consist essentially of a nickel- or cobalt-based superalloy or titanium alloy.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
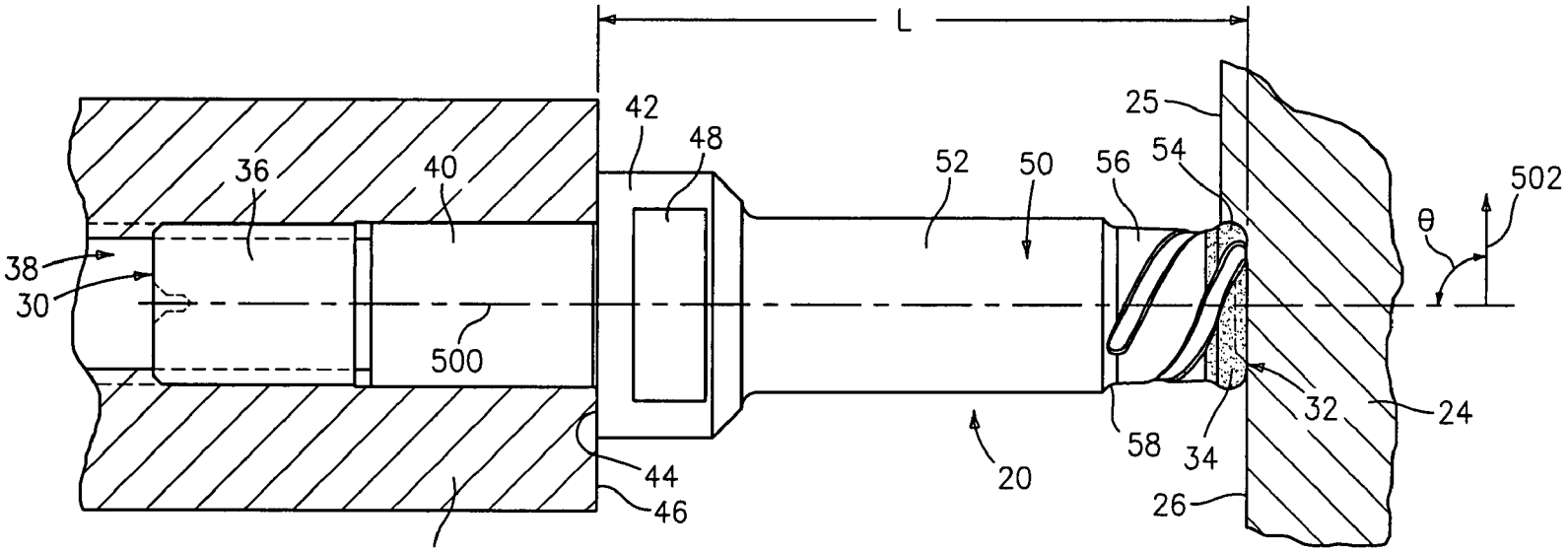
FIG. 1 is a side view of a quill according to principles of the invention.
Figure 3:
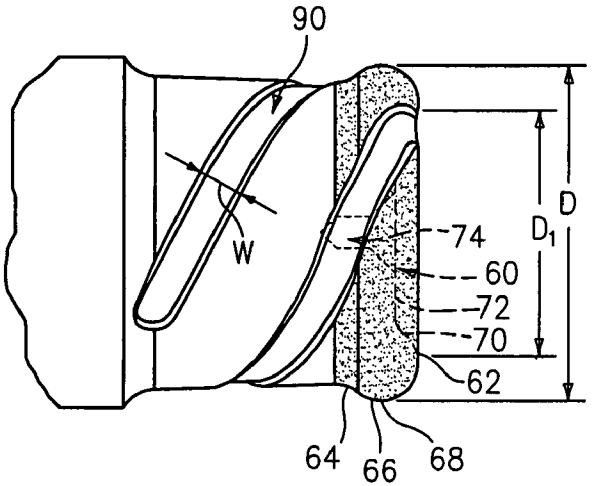
FIG. 3 is a front view of the quill tip of FIG. 2.

FIG. 1 shows an abrasive quill 20 mounted in a multi-axis machine tool spindle 22. The machine tool rotates the quill about a central longitudinal axis 500 and translates the quill in one or more directions (e.g., a direction of translation 502) to machine a workpiece 24. Exemplary rotation is in a direction 504 (FIG. 3) at a speed in excess of 10,000 rpm (e.g., in the range of 40,000 rpm-90,000 rpm). The traversal of the quill removes material below a surface 25 and leaves a cut surface 26 on the workpiece. The machine tool may further reorient the axis 500. Alternatively or additionally, the machine tool may reposition or reorient the workpiece. The exemplary quill 20 includes a metallic body extending from an aft end 30 to a front (tip) end 32. An abrasive coating 34 on the tip end provides cutting effectiveness.

Near the aft end 30, the exemplary quill includes an externally threaded portion 36 for mating by threaded engagement to a correspondingly internally threaded portion of a central aperture 38 of the spindle 22. Ahead of the threaded portion 36, an unthreaded cylindrical portion 40 fits with close tolerance to a corresponding unthreaded portion of the aperture 38 to maintain precise commonality of the quill/spindle/rotation axis 500. A wrenching flange 42 is forward (tipward) of the unthreaded portion 40 and has a radially-extending aft surface 44 abutting a fore surface 46 of the spindle. The exemplary flange 42 has at least a pair of parallel opposite wrench flats 48 for installing and removing the quill via the threaded engagement. Alternatively, features other than the threaded shaft and wrenching flange may be provided for use with tools having different quill interfaces such as are used with automatic tool changers.

A shaft 50 extends generally forward from the flange 42 to the tip 32. In the exemplary embodiment, the shaft 50 includes a proximal portion 52, a toroid-like tip protuberance portion 54, and an intermediate portion 56. In the exemplary embodiment, the proximal portion 52 is relatively longer than the combined protuberance 54 and intermediate portion 56 and of generally relatively greater diameter than at least the intermediate portion and, in the exemplary embodiment, the protuberance 54. A shoulder 58 (e.g., beveled) separates the proximal portion 52 from the intermediate portion 56. The tip protuberance 54 is sufficiently small to make the required cut features. The intermediate portion 56 is advantageously narrow enough and long enough to avoid interfering with other portions of the part during the machining. The relative thickness of the proximal portion 52 provides strength. The length of the proximal portion 52 (combined with the lengths of intermediate portion and protuberance) provides the desired separation of the tip from the tool spindle. Such separation may be required to make the desired cut while avoiding interference between the spindle and any portion of the part that might otherwise interfere with the spindle.

Figure 2:
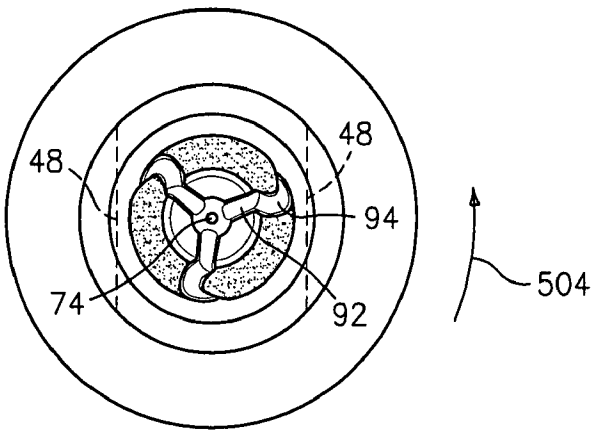
FIG. 2 is an enlarged view of a tip area of the quill of FIG. 1.
Figure 4:
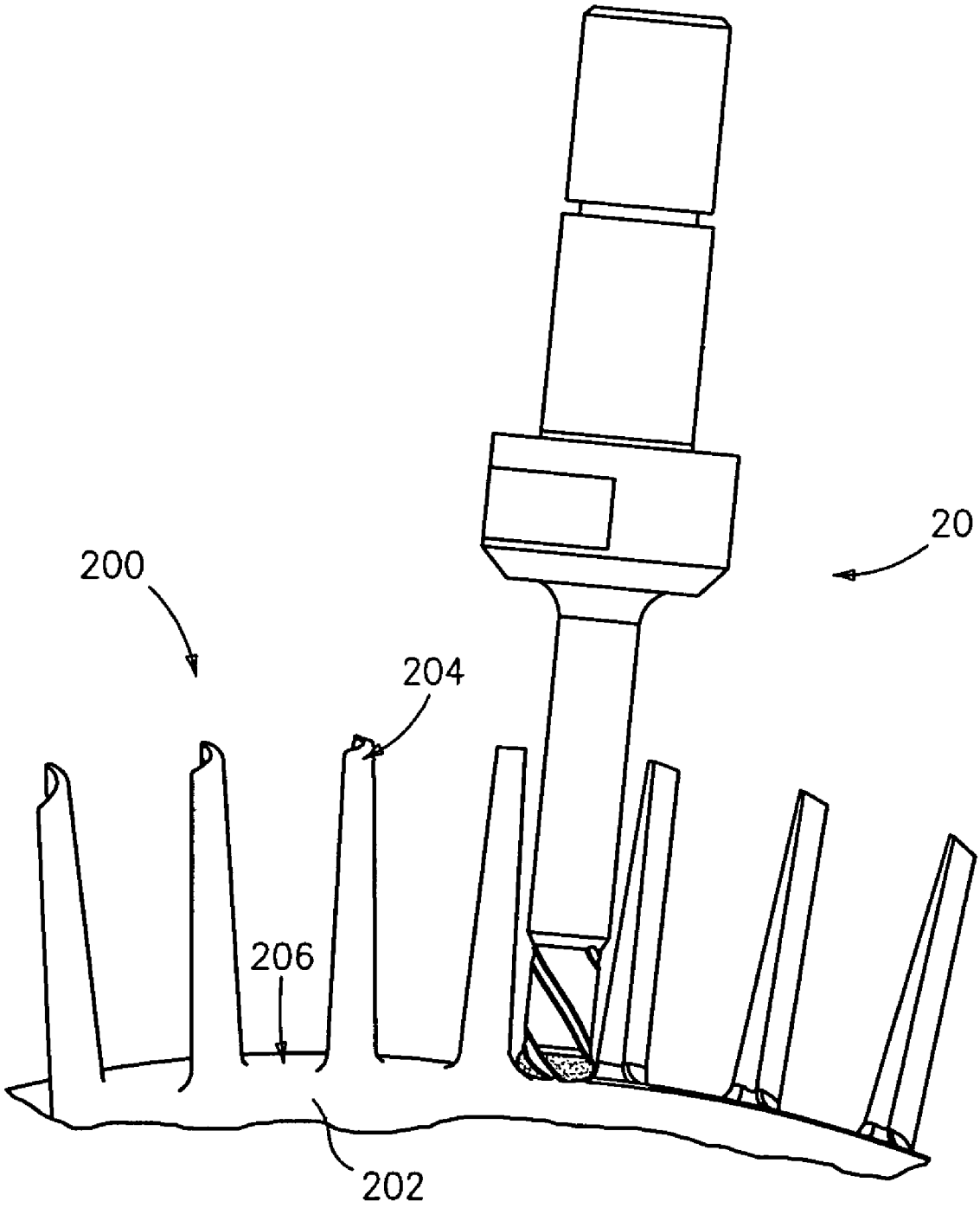
FIG. 4 is a view of the quill of FIG. 1 machining an interblade floor of an integrally bladed rotor.

In the exemplary embodiment, the tip 32 (FIG. 2) includes a central recess 60 surrounded by a rim 62. In longitudinal section, the protuberance 54 has a concave transition 64 to the intermediate portion 56. A convex portion 66 extends forward thereof through an outboardmost location 68 and back radially inward to form the rim 62. From the rim, the surface continues to extend inward and aftward along a portion 70 defining a relatively broad forward portion of the recess 60. The forward portion of the recess has a generally radially-extending annular base 72. The recess includes a smaller diameter pilot hole portion 74 extending aftward from the base 72. These features are discussed further below with reference to exemplary manufacturing parameters. The presence of the recess 60 eliminates the low speed contact region otherwise present at the center of the tip. This permits a traversal direction 502 at an angle θ close to 90° off the longitudinal/rotational axis 500. For example, FIG. 4 shows exemplary positioning of the quill 20 during one stage of the machining of an integrally bladed rotor 200 (IBR, also known as a blisk). The unitarily-formed blisk 200 has a hub 202 from which a circumferential array of blades 204 radially extend. The quill 20 is shown grinding an interblade floor 206 between adjacent blades 204. The same or a different quill may be used to machine surface contours (e.g., pressure side concavity and suction side convexity) of the blades. Traversal at or near normal to the quill axis permits machining of the floor 206 in a relatively small number of passes (e.g., contrasted with a more sharply tipped quill at a greater angle off normal machining very narrow, highly concave passes which must be very closely spaced to achieve near flatness and which may require substantial additional smoothing.

Figure 5:
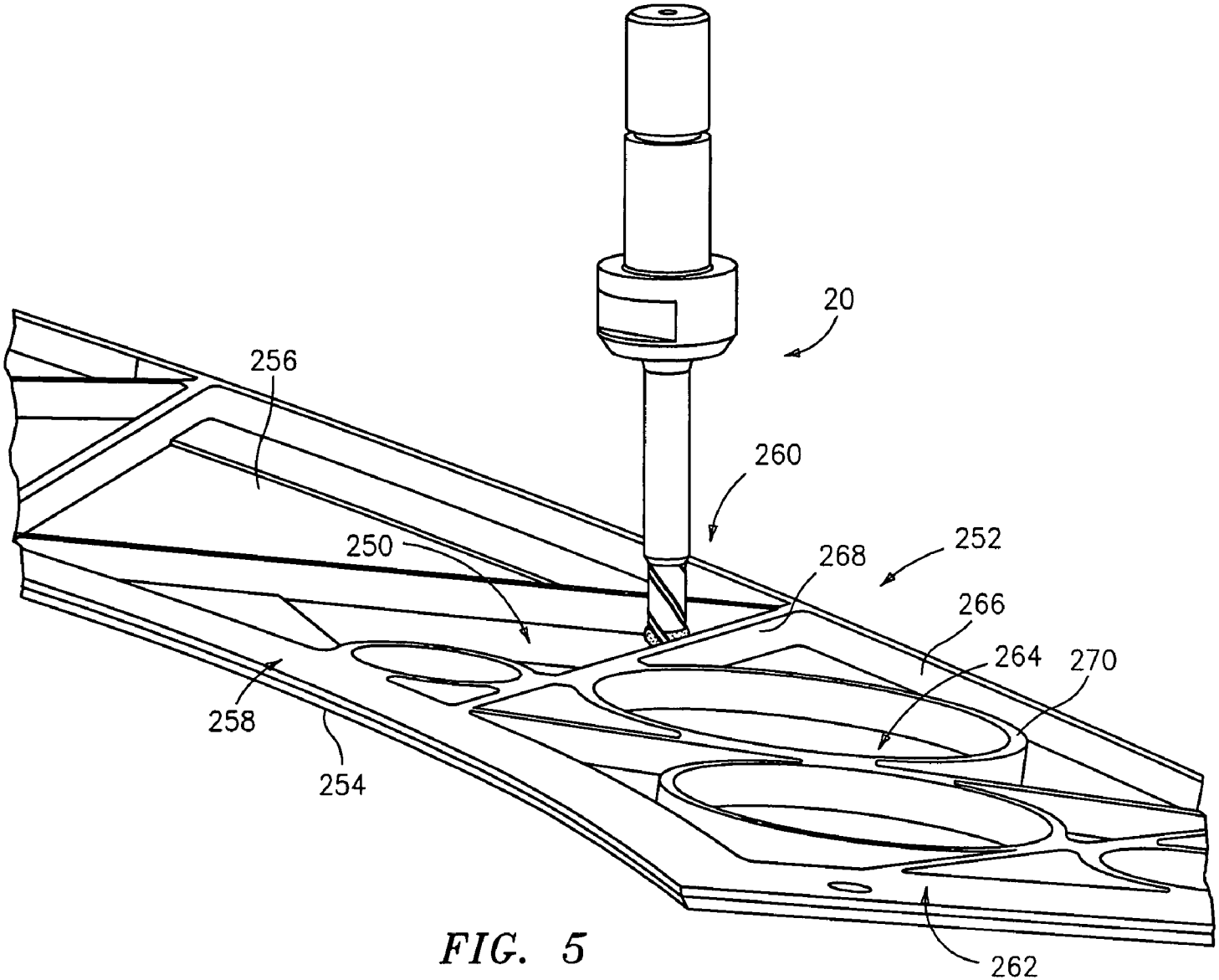
FIG. 5 is a view of the quill of FIG. 1 machining a turbine engine case segment.

Another application involves the machining of turbine engine case components. Exemplary case components are panels formed as cylindrical or frustoconical shell segments. FIG. 5 shows the quill 20 machining one of several pockets 250 in a titanium alloy duct segment 252. The exemplary segment 252 is unitarily formed including inboard (interior) and outboard (exterior) surfaces 254 and 256. The exemplary segment extends between upstream (fore) and downstream (aft) ends 258 and 260. The segment also has a pair of longitudinal ends 262. The exemplary segment further includes aperture's ports 264. The machining of the pockets 250 in the exemplary segment leaves an outwardly extending perimeter rib 266, intermediate structural reinforcing ribs 268 (e.g., spanning between portions of the perimeter rib 266), and aperture-circumscribing ribs 270. Depending upon the implementation, the ribs 270 may define bosses with a mounting of conduits, instruments, actuators, or other components which may pass through the segment. Use of the exemplary quill and traversal at or near normal to its axis may provide convenient machining of relatively flat pocket floors along the exterior surface 256 and relatively narrow (especially narrow-based) ribs for substantial lightening of the segment.

An additional feature of the exemplary quill 20 is the presence of elongate recesses 90, which may serve to help evacuate grinding debris and/or may help to improve coolant flow to the grinding zone. In the exemplary embodiment, the recesses 90 extend from the central recess 60 through the rim 62 and spiral along the intermediate portion 56. The exemplary recesses 90 have radially-extending root portions 92 within the recess 60 leading to arcuate portions 94 cutting through and castellating the rim 62 and then spiraling along the intermediate portion 56. The exemplary spiraling may have tangential and longitudinal components that differ along the length of the recesses 90 so as to not be a helix.

In an exemplary manufacturing process, the basic quill body is machined (e.g., via one or more lathe turning steps or grinding steps) from steel stock, including cutting the threads on the portion 36 and drilling the pilot hole and counterbore at the tip. The elongate recesses may then be formed (e.g., by end milling). There may be heat and/or mechanical surface treatment steps. The abrasive may then be applied as a coating (e.g., via electroplating). Exemplary superabrasive material may be selected from the group of cubic boron nitride (e.g., plated or vitrified), diamond (particularly useful for machining titanium alloys), silicon carbide, and aluminum oxide. The exemplary superabrasive material may have a grit size in the range of 40/45 to 325/400 depending on the depth of the cut and the required surface finish (e.g., 10 μin or finer). A mask may be applied prior to said coating and removed thereafter to protect areas where coating is not desired. For example, the mask may confine the coating to the tip protuberance portion 54. The mask may also cover the portions of the recesses interrupting the protuberance and may cover the counterbore to keep these areas uncoated so as to maximize the capacity for coolant flow through these areas. Particularly for a vitrified coating, the as-applied coating may be dressed to improve machining precision. Alternative orders are possible, for example including applying the abrasive before forming the elongate recesses. After use, the coating may be cleaned and/or redressed (e.g., via a diamond wheel) at one or more times. To remanufacture the quill, additional coating may be applied (e.g., optionally after a removal of some or all remaining used/worn/contaminated coating). For example, if coating in the recesses or counterbore was relatively unworn, it would be advantageous to either remove some or all of the depth of coating from these areas (e.g., absolutely or proportionally greater than any removal from more worn areas). Thus, after recoating, the coating thickness in these areas would not be too great so as to interfere with their operation. Alternatively or additionally, these areas could be masked during the recoating process. An advantageous process removes all the abrasive coating (e.g., via chemical means) from the quill prior to application of the replacement coating.

An exemplary projecting length L of the quill forward of the spindle is 57 mm, more broadly, in a range of 40-80 mm. An exemplary protuberance diameter D is 14 mm, more broadly 8-20 mm. An exemplary recess diameter $D_1$ is 20-80% of D, more narrowly 30-70%. An exemplary elongate recess width W is 1.5 mm, more broadly 0.8-3.0 mm. An exemplary elongate recess depth is 30%-70% of the width (e.g., 0.8 mm, more broadly 0.4-2.0 mm). The rim may be longitudinally radiused with an exemplary radius of curvature of 1.6 mm, more broadly 0.5 mm-3.0 mm (e.g., at the location 68 and forward therefrom).

One or more embodiments of the present invention have been described. Nevertheless, it will be understood that various modifications may be made without departing from the spirit and scope of the invention. For example, the principles may be applied to various existing or yet-developed quill configurations including point SAM quills, flank SAM quills, and profiled abrasive quills (such as those used for grinding fir tree slots). When the recesses are present, they need not be identical (e.g., a pair configured to introduce coolant to the counterbore and a pair configured to evacuate coolant and debris therefrom). Accordingly, other embodiments are within the scope of the following claims.

What is claimed is:

1. A process for point abrasive machining of a workpiece comprising the steps of:

providing a tool having a tip grinding surface coated with an abrasive and having a central tip recess;

installing the tool in a machine tool;

orienting said tool relative to a surface of said workpiece to be machined so that there is contact between said surface to be machined and said grinding surface; and forming a part by removing material at said contact by:

rotating said tool about the central longitudinal axis; and translating the tool relative to the workpiece and off parallel to the longitudinal axis while machining the workpiece, wherein:

the tip grinding surfaces is at least partially along an annular tip protuberance;

a plurality of additional recesses extend from the central recess through the tip protuberance; and during the machining, the additional recesses facilitate the evacuation of grinding debris.

2. The process of claim 1 wherein said rotating step comprises rotating said tool at a speed in the range of 40,000 to 120,000 revolutions per minute.

3. The process of claim 1 further comprising reorienting the longitudinal axis relative to the workpiece while machining the workpiece.

4. The process of claim 1 wherein:

the workpiece comprises a component selected from the group consisting of integrally bladed disks and turbine engine case components; and the machining forms an interblade floor of such a disk or an exterior pocket of such a case component.

5. The process of claim 1 wherein the workpiece is a turbine engine case segment and the machining forms a rib defining a boss.

6. The process of claim 1 wherein the workpiece consists essentially of titanium alloy.

7. The process of claim 1 wherein the workpiece comprises a nickel- or cobalt-based superalloy.

8. The process of claim 1 wherein the workpiece consists essentially of a nickel- or cobalt-based superalloy.

9. The process of claim 1 wherein the translating is off normal to the longitudinal axis.

10. The process of claim 1 wherein:

a plurality of additional recesses extend from the central recess; and during the machining, the additional recesses facilitate the evacuation of grinding debris.

11. The process of claim 1 wherein:

a plurality of additional recesses extend from the central recess; and during the machining, the additional recesses improve coolant flow to a grinding zone.

12. The process of claim 1 wherein the orienting comprises a plurality of reorientings so that the translating comprises a plurality of relative passes at different angles to each other.

13. The process of claim 1 wherein the translating comprises a plurality of parallel passes.

14. The process of claim 1 wherein the translating comprises a plurality of parallel passes performed by the machine tool.

15. The process of claim 1 wherein the translating is performed by the machine tool.

16. The process of claim 1 wherein the orienting comprises a plurality of reorientings performed by the machine tool so that the translating comprises a plurality of relative passes at different angles to each other.

17. A process for point abrasive machining of a workpiece comprising the steps of:

providing a tool having:

a tip grinding surface at least partially along a tip protuberance coated with an abrasive and having a central tip recess; and an intermediate portion of smaller diameter than a diameter of the tip protuberance;

orienting said tool relative to a surface of said workpiece to be machined so that there is contact between said surface to be machined and said grinding surface; and forming a part by removing material at said contact by:

rotating said tool about the central longitudinal axis; and translating the tool relative to the workpiece and off parallel to the longitudinal axis while machining the workpiece, during the machining, the smaller diameter of the intermediate portion relative to the tip protuberance being effective to avoid interference between the tool and the workpiece.

18. The process of claim 17 wherein the tip protuberance is formed by in a metal body of the tool.

19. The process of claim 17 wherein the tip protuberance is of shorter longitudinal span than the intermediate portion.

20. The process of claim 19 wherein a proximal portion, proximal of the intermediate portion, is longer than a combined length of the tip protuberance and the intermediate portion and is of greater diameter than the tip protuberance so as to provide strength while permitting the intermediate portion to avoid interference with the workpiece, the proximal portion, intermediate portion, and protuberance being formed of a single piece.

* * * * *